US009925992B2

(12) United States Patent
Cooper et al.

(10) Patent No.: US 9,925,992 B2
(45) Date of Patent: Mar. 27, 2018

(54) SYSTEM AND METHOD FOR COMMUNICATING IN A VEHICLE CONSIST

(71) Applicant: General Electric Company, Schenectady, NY (US)

(72) Inventors: Jared Klineman Cooper, Melbourne, FL (US); Eugene Smith, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 540 days.

(21) Appl. No.: 14/514,633

(22) Filed: Oct. 15, 2014

(65) Prior Publication Data

US 2016/0107661 A1 Apr. 21, 2016

(51) Int. Cl.
*B61L 15/00* (2006.01)

(52) U.S. Cl.
CPC ..... *B61L 15/0072* (2013.01); *B61L 15/0018* (2013.01); *B61L 15/0027* (2013.01)

(58) Field of Classification Search
CPC ..... B61L 15/0018; B61L 15/0027; B61L 15/0072
See application file for complete search history.

(56) References Cited

U.S. PATENT DOCUMENTS 6,862,502 B2 3/2005 Peltz et al.
7,395,141 B1 7/2008 Seck et al.
7,664,459 B2 2/2010 Smith, Jr. et al.
7,715,956 B2 5/2010 Bryant
7,983,805 B2 7/2011 Bryant
8,050,809 B2 11/2011 Geiger et al.
8,190,313 B2 5/2012 Moffitt et al.
8,190,315 B2 5/2012 Kraeling et al.
8,280,566 B2 10/2012 Foy, III et al.
8,328,144 B2 12/2012 Smith
8,328,145 B2 12/2012 Smith
8,532,850 B2 9/2013 Cooper et al.
8,538,608 B2 9/2013 Meltser et al.
8,583,299 B2 11/2013 Goodermuth et al.
8,589,000 B2 11/2013 Moffitt et al.
8,655,517 B2 2/2014 Brand et al.
8,655,519 B2 2/2014 Cooper et al.
(Continued)

OTHER PUBLICATIONS

Australian Office Action issued in connection with corresponding AU Application No. 2015238861 dated Jul. 13, 2016.

*Primary Examiner* — Zachary L Kuhfuss
(74) *Attorney, Agent, or Firm* — GE Global Patent Operation; John A. Kramer

(57) ABSTRACT

Systems and methods for communicating in a vehicle consist wirelessly communicate (using communication assemblies disposed onboard a vehicle consist) a movement control data message via a first wireless communication path between a lead vehicle and a remote vehicle of the vehicle consist. The vehicle consist includes the lead vehicle and the remote vehicle operably coupled with each other to travel along a route. A non-movement control data message also is wirelessly communicated, but via a different, second wireless communication path between the lead vehicle and the remote vehicle. The movement control data message is communicated to remotely control operation of the remote vehicle from the lead vehicle. The non-movement control data message is communicated to remotely report a status of a component onboard the remote vehicle.

14 Claims, 3 Drawing Sheets

(56) References Cited

U.S. PATENT DOCUMENTS

| | | | |
|---|---|---|---|
| 8,702,043 | B2 | 4/2014 | Daum et al. |
| 8,798,821 | B2 | 8/2014 | Kraeling et al. |
| 8,825,239 | B2 | 9/2014 | Cooper et al. |
| 2014/0005915 | A1 | 1/2014 | Smith et al. |
| 2014/0121953 | A1 | 5/2014 | Kraeling et al. |
| 2014/0188306 | A1 | 7/2014 | Kumar et al. |

SYSTEM AND METHOD FOR COMMUNICATING IN A VEHICLE CONSIST

FIELD

Embodiments of the inventive subject matter described herein relate to communications between vehicles in a vehicle consist.

BACKGROUND

Some known vehicle consists include several powered vehicles that generate tractive effort for propelling the vehicle consists along a route. For example, trains may have several locomotives coupled with each other that propel the train along a track. The locomotives may communicate with each other in order to coordinate the tractive efforts and/or braking efforts provided by the locomotives. As one example, locomotives may be provided in a distributed power (DP) arrangement with one locomotive designated as a lead locomotive and other locomotives designated as remote locomotives. The lead locomotive may direct the tractive and braking efforts provided by the remote locomotives during a trip of the consist.

Some known consists use wireless communication between the locomotives for coordinating the tractive and/or braking efforts. For example, a lead locomotive can issue commands to the remote locomotives. The remote locomotives receive the commands and implement the tractive efforts and/or braking efforts directed by the commands. The remote locomotives can communicate responsive messages to the lead locomotive to notify the lead locomotive that the remote locomotive received the command and/or to report the current status of the remote locomotive.

The remote locomotives also can monitor statuses of components of the remote locomotives and report the statuses of these components to the lead locomotive. For example, the remote locomotives can determine if traction motors of the remote locomotives are not loading, can determine statuses of control systems onboard the remote locomotives, or the like. The statuses of these components can be wirelessly communicated back to the lead locomotive. But, the amount of data used to communicate these statuses can be considerably larger than the data communicated from the lead locomotive to command the remote locomotives and/or for the remote locomotives to confirm receipt of the commands. Due to wireless bandwidth limitations, the larger amount of data used to report information that is not used to control movement of the remote locomotives (e.g., commands from the lead locomotive and/or confirmations from the remote locomotives) can cause commands from the lead locomotive and/or confirmations from the remote locomotives to not be communicated. Responsive to not receiving a command from a lead locomotive and/or a confirmation from a remote locomotive (e.g., within a designated period of time), the consist may implement various safety precautions, such as stopping movement of the consist. As a result, travel of the consist can be significantly impacted.

BRIEF DESCRIPTION

In one embodiment, a method (e.g., for communicating in a vehicle consist) includes wirelessly communicating (using communication assemblies disposed onboard a vehicle consist) a movement control data message via a first wireless communication path between a lead vehicle and a remote vehicle of the vehicle consist. The vehicle consist includes the lead vehicle and the remote vehicle operably coupled with each other to travel along a route. The method also includes wirelessly communicating a non-movement control data message via a different, second wireless communication path between the lead vehicle and the remote vehicle. The movement control data message is communicated to remotely control operation of the remote vehicle from the lead vehicle. The non-movement control data message is communicated to remotely report a status of a component onboard the remote vehicle.

In another embodiment, a system (e.g., a communication system of a vehicle consist) includes a remote communication assembly configured to be disposed onboard a remote vehicle of a vehicle consist that also includes a lead vehicle operably coupled with the remote vehicle to travel with each other along a route. The remote communication assembly is configured to wirelessly receive a movement control data message via a first wireless communication path between the lead vehicle and the remote vehicle of the vehicle consist. The remote communication assembly also can be configured to wirelessly communicate a non-movement control data message with the lead vehicle via a different, second wireless communication path between the lead vehicle and the remote vehicle. The remote communication assembly can be configured to receive the movement control data message to remotely control operation of the remote vehicle from the lead vehicle. The remote communication assembly can be configured to communicate the non-movement control data message to remotely report a status of a component onboard the remote vehicle.

In another embodiment, another system (e.g., another communication system of a vehicle consist) includes a radio communication unit configured to be disposed onboard a remote vehicle of a vehicle consist that also includes a lead vehicle. The radio communication unit is configured to wirelessly receive a radio control message configured to remotely control movement of the remote vehicle from the lead vehicle. The system also includes a non-radio communication unit configured to be disposed onboard the remote vehicle and to wirelessly communicate a status message to the lead vehicle. The status message is representative of a status of one or more components of the remote vehicle. The radio communication unit is configured to wirelessly receive the radio control message within a designated time limit such that the radio control message temporally coordinates a change in the movement of the remote vehicle with a change in movement of the lead vehicle. The non-radio communication unit is configured to wirelessly communicate the status message without temporally coordinating the status message with the change in movement of the remote vehicle or the change in movement of the lead vehicle.

BRIEF DESCRIPTION OF THE DRAWINGS

Reference is now made briefly to the accompanying drawings, in which.

DETAILED DESCRIPTION

Figure 1:
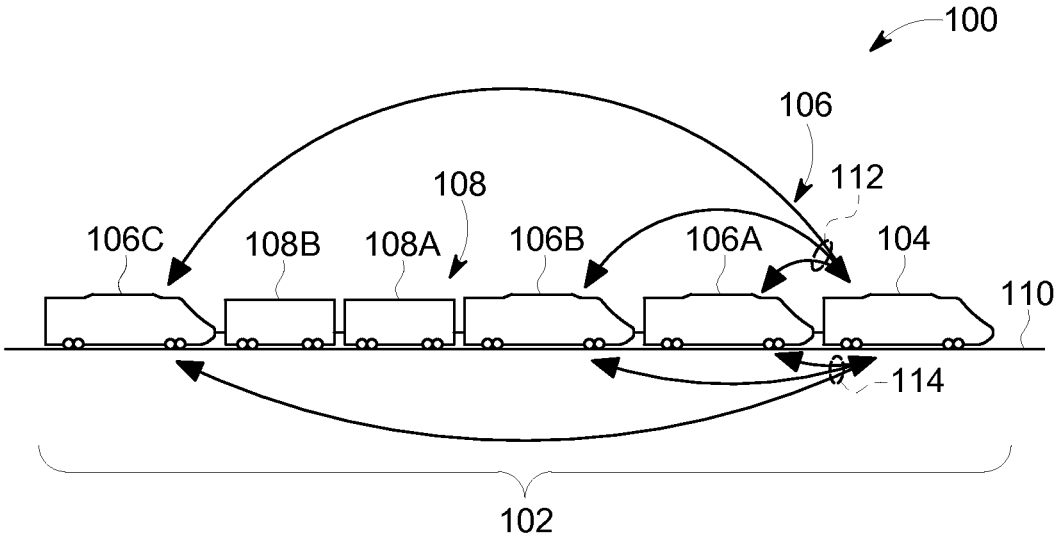
FIG. 1 is a schematic view of one embodiment of a communication system of a vehicle consist.

One or more embodiments of the inventive subject matter described herein provides for methods and systems for communicating between vehicles in a vehicle consist. Embodiments described herein can be used with vehicle consists that include two or more propulsion-generating vehicles that are directly or indirectly mechanically coupled with each other, such as a rail vehicle consist having two or more locomotives mechanically coupled with each other directly or indirectly (e.g., by one or more other locomotives, rail cars, or the like). Embodiments described herein optionally can be used with vehicle consists having two or more propulsion-generating vehicles that are not mechanically coupled with each other. For example, two or more mining vehicles, automobiles, marine vessels, or other types of vehicles (e.g., other off highway vehicles that are not designed or legally permitted to travel on public roadways) may wirelessly communicate with each other to coordinate movements without the vehicles being coupled with each other.

At least one of the vehicles in the consist is a lead vehicle that remotely controls operations of one or more other remote vehicles. The term "lead" does not necessarily mean that the lead vehicle is at the leading end of the consist along a direction of travel. Instead, the lead vehicle may be disposed at the middle or trailing end of the consist, or may be at the leading end of the consist. The lead vehicle communicates wireless command messages to remotely coordinate movements of the remote vehicles. This type of operation may be referred to as distributed power (DP) operation of the consist. The remote vehicles respond with confirmation messages that can indicate receipt of the command messages and/or current operational states of the remote vehicles (e.g., which indicates that the command messages are being implemented). The messages that are communicated between the lead vehicle and the remote vehicles to remotely control movement of the remote vehicles, to indicate receipt of the command message, and/or to confirm that the operations instructed by the command message have been or are being implemented can be referred to as movement control data messages. In one embodiment, these types of messages are needed to remotely control operations of the remote vehicles from the lead vehicle, as without communication of these messages, the lead vehicle may not be able to control the remote vehicles. Because the lead vehicle communicates these messages to coordinate movements of the lead and remote vehicles with each other (e.g., to ensure that throttle changes, brake changes, or the like, at different vehicles occur at the same time or within a designated time period of each other), the communication of these messages may be time-dependent such that the messages may need to be successfully sent and received within designated time periods (e.g., within ten milliseconds, within thirty milliseconds, within a second, or the like).

Conversely, the remote vehicles also may communicate messages to the lead vehicle that are not needed for the lead vehicle to remotely control operations of the remote vehicles. These messages may report statuses of components of the remote vehicles, such as errors, faults, or other problems with fraction motors, communication units, control units, temperatures, pressures, or the like. The vehicle consist may continue to travel with the lead vehicle continuing to remotely control movements of the remote vehicles if these types of messages are no longer able to be communicated. These types of messages can be referred to as non-movement control data messages. The communication of these messages may not be time dependent because a time delay in communicating these types of messages may not adversely impact the coordination of movement of the lead and remote vehicles.

Instead of communicating both the movement control data messages and the non-movement control data messages on the same wireless communication path, a communication system of the vehicle consist can communicate the different types of messages on different communication paths. A communication path can represent wireless communication of a message using a type of technology. For example, the lead and remote vehicles can communicate movement control data messages using wireless radios as one communication path. These vehicles can communicate non-movement control data messages using wireless cellular communication units as another, different communication path. The communication paths may differ from each other in that the paths are used to communicate the messages in different frequencies or ranges of frequencies, different formats of the messages (e.g., the data packets are formatted differently), different sizes of the messages (e.g., in terms of bytes), in different time periods, or the like. Communicating the different messages using different communication paths can provide more available bandwidth for one type of messages (e.g., movement control data messages) by having the larger messages (e.g., non-movement control data messages) being communicated over a separate path. This can reduce the number of times that movement control data messages are not successfully communicated between vehicles. In an embodiment, movement control data messages are communicated over a first wireless communication path and non-movement control data messages are communicated over a different, second wireless communication path, wherein the communication paths are different from one another in that the first wireless communication path has a first frequency bandwidth and the second wireless communication path has a second frequency bandwidth that does not overlap with the first frequency bandwidth.

FIG. 1 is a schematic view of one embodiment of a communication system 100 of a vehicle consist 102. The illustrated vehicle consist 102 includes propulsion-generating vehicles 104, 106 (e.g., vehicles 104, 106A, 106B, 106C) and non-propulsion-generating vehicles 108 (e.g., vehicles 108A, 108B) mechanically coupled with each other. The propulsion-generating vehicles are capable of self-propulsion while the non-propulsion-generating vehicles are not capable of self-propulsion. The propulsion-generating vehicles 104, 106 are shown as locomotives, the non-propulsion-generating vehicles 108 are shown as rail cars, and the vehicle consist 102 is shown as a train in the illustrated embodiment. Alternatively, the vehicles 104, 106 may represent other vehicles, such as automobiles, marine vessels, or the like, and the vehicle consist 102 can represent a grouping or coupling of these other vehicles. In one embodiment, the vehicles 104, 106 may not be mechanically coupled with each other. For example, the vehicles 104, 106 may be separate from each other, but may communicate with each other to coordinate operations of the vehicles 104, 106. For example, the vehicle 104 may wirelessly communicate operational command messages to the vehicles 106 that remotely control or direct operational settings of the vehicles 106 so that the vehicles 104, 106 can remain designated distances from each other or otherwise travel together. The number and arrangement of the vehicles 104, 106 in the vehicle consist 102 are provided as one example and are not intended as limitations on all embodiments of the inventive subject matter described herein.

The vehicles 104, 106 can be arranged in a distributed power (DP) arrangement. For example, the vehicles 104, 106 can include a lead vehicle 104 that issues movement control data messages to the other vehicles 106A, 106B, 106C which are referred to herein as remote vehicles. The designations "lead" and "remote" are not intended to denote spatial locations of the vehicles 104, 106 in the vehicle consist 102, but instead are used to indicate which vehicle 104, 106 is communicating (e.g., transmitting, broadcasting, or a combination of transmitting and broadcasting) movement control data messages and which vehicles 104, 106 are being remotely controlled using the movement control data messages. For example, the lead vehicle 104 may or may not be disposed at the front end of the vehicle consist 102 (e.g., along a direction of travel of the vehicle consist 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or vehicles 108.

The movement control data messages may include directives that direct operations of the remote vehicles. These directives can include propulsion commands that direct propulsion subsystems of the remote vehicles to move at a designated speed and/or power level, brake commands that direct the remote vehicles to apply brakes at a designated level, and/or other commands. The lead vehicle 104 issues the movement control data messages to coordinate the tractive efforts and/or braking efforts provided by the vehicles 104, 106 in order to propel the vehicle consist 102 along a route 110, such as a track, road, waterway, or the like. The remote vehicles 106 can respond to the lead vehicle 104 with messages that confirm receipt of the movement control data messages.

The movement control data messages can be wirelessly communicated using a first communication path 112 of the communication system 100 described below. Other types of messages (e.g., messages that are not used to remotely direct operations of another vehicle 104, 106 and/or to confirm receipt of the movement control data messages) may be communicated using a different, second communication path 114 of the communication system 100. For example, non-movement control data messages may be communicated from the remote vehicles 106 to the lead vehicle 104 using the second communication path 114.

The first and second communication paths 112, 114 may differ from each other in one or more ways. The following examples of differences between the paths 112, 114 are not meant to encompass all differences between the paths 112, 114, and the paths 112, 114 may differ in any combination of the following examples and/or in other ways.

As one example, the first communication path 112 can be a radio communication path and the second communication path 114 may be a non-radio communication path. A radio communication path can represent wireless communications between two or more radio communication units. These radio communication units can wirelessly communicate messages at frequencies below 500 megahertz (Mhz), between 450-460 Mhz, or within another frequency range or band. The second communication path 114 can represent wireless communication of messages that does not use radio communication units, does not use the frequencies used by the radio communication units communicating over the first communication path 112, or the like. In one embodiment, a radio communication path uses frequencies between 450 and 460 Mhz while a non-radio communication path uses another frequency. In one embodiment, a radio communication path communicates messages by broadcasting the messages. As a result, multiple, different communication units in the same or different locations can receive the same message sent over a radio communication path. In contrast, a non-radio communication path can communicate messages by transmitting the messages to a single other communication unit. For example, a first communication unit can transmit a message to a second communication unit over a non-radio communication path, but not to a third communication unit. Instead, a separate transmission or communication path may be needed to communicate the message to the third communication unit. In one embodiment, a radio communication path communicates the messages directly between two or more communication units. For example, a message that is broadcast by a first communication unit may be communicated over the radio communication path to a second communication unit, without the message being communicated to and/or repeated, relayed, or otherwise re-communicated by another device, such as a cellular tower, repeater device, or the like. In contrast, non-radio communication links, such as cellular links, may involve or require the message to be sent from the first communication unit to a cellular tower, which then relays the message to the second communication unit.

As another example, the second communication path 114 can be a cellular communication path and the first communication path 112 may be a non-cellular communication path. A cellular communication path can represent wireless communications between two or more cellular communication units, such as cellular telephones, that communicate over or via one or more cellular networks. The communication units used to communicate over or via the first communication path 112, on the other hand, may not communicate over or via any cellular networks. The cellular communication units may require use of a subscriber identity module (SIM) card, while the communication units used to communicate over or via the first communication path 112 do not require such a card. The cellular communication units may communicate at greater frequencies than the communication units used to communicate over or via the first communication path 112, such as by communicating at frequencies at or above 800 Mhz, 850 Mhz, 900 Mhz, or the like. The cellular communication units may communicate using third or fourth generation technologies (e.g., 3G or 4G), which may involve code division multiple access (CDMA) communications, time division multiple access (TDMA), or the like, while communication units used to communicate over or via the first communication path 112 do not use these types of technologies.

As another example, the second communication path 114 can be a satellite component communication path and the first communication path 112 may be a non-satellite communication path. A satellite communication path can represent wireless communications between two or more communication units onboard the vehicle consist 102 via one or more off-board communication units, such as a satellite. The communication units can communicate messages to the satellite, which then relays the messages to other communication units. In contrast, the first communication path 114 may involve two or more communication units directly communicating with each other without the messages being relayed or otherwise communicated through one or more intermediary communication units, such as a satellite.

As another example, the first and second communication paths 112, 114 may have different amounts of bandwidth for wirelessly communicating the respective messages. The first communication path 112 may have a smaller bandwidth than the second communication path 112, 114. For example, the first communication path 112 may have a smaller range of frequencies over which to wirelessly communicate the movement control data messages relative to the range of frequencies over which the second communication path 114 wirelessly communicates the non-movement control data messages.

As another example, the communication paths 112, 114 may differ in the formats of the messages that are communicated in the communication paths 112, 114. The movement control data messages that are communicated via the first communication path 112 may have a syntax, data packet structure, or other format that differs from the syntax, data packet structure, or the like, of the non-movement control data messages that are communicated via the second communication path 114. The formats of the messages communicated on the different paths 112, 114 may be different such that a movement control data message cannot be communicated (e.g., sent and/or received) by communication units via the second communication path 114 and/or the non-movement control data message cannot be communicated by communication units via the first communication path 112.

As another example, the communication paths 112, 114 may differ in the sizes of the messages that are communicated via the communication paths 112, 114. The movement control data messages may be smaller in terms of bits, bytes, or the like, than the non-movement control data messages. For example, the first communication path 112 may be limited in bandwidth such that the first communication path 112 is unable to communicate the larger sizes of the non-movement control data messages without dropping one or more of the messages.

As another example, the first communication path 112 may have the ability to communicate the movement control data messages in a time-dependent manner while the second communication path 114 may not have such an ability. The time-dependent manner represents the communication of the messages within designated time periods (e.g., within ten milliseconds, twenty milliseconds, fifty milliseconds, one second, etc.) so that the lead vehicle 104 can coordinate changes in operations of the remote vehicles 106 and/or the lead vehicle 104 with each other. For example, in order to ensure that all remote vehicles 106 change throttle settings or positions to settings designated by the movement control data messages at the same time or within the designated time period, the lead vehicle 104 may wirelessly transmit and/or broadcast the movement control data messages using the first communication path 112. The first communication path 112 may allow for the messages to be communicated continuously or within relatively short time periods. For example, if the time period within which the throttle settings of the remote vehicles 106 is to change is thirty milliseconds, then the first communication path 112 may allow for the movement control data messages to be communicated (e.g., once or repeatedly) from the lead vehicle 104 to the remote vehicles 106 in a sufficiently short time period that the throttle settings changes occur within thirty milliseconds. The second communication path 114, on the other hand, may communicate messages in bursts separated by time delays. For example, the second communication path 114 may communicate all or part of a non-movement control data message during a first time period (e.g., lasting fifty milliseconds, 100 milliseconds, or another period of time) then stop communication for a non-zero time delay (e.g., lasting the same or shorter time period than the first time period), then communicate more of or another non-movement control data message during a second time period, then stop communication for another time delay, and so on. In one embodiment, none of the non-movement control data messages is communicated during the non-zero time delays. Because of the limited time periods or windows during which messages can be communicated via the second communication path 114, the movement control data messages may not be able to be communicated via this path 114. For example, the lead vehicle 104 may need to change operation of one or more remote vehicles 106 by sending a movement control data message between the communication bursts of the second communication path 114 in order to coordinate movements of the vehicles 104, 106. Because the message cannot be communicated during the time delay between bursts in one embodiment, the second communication path 114 may not be able to be used for the movement control data messages.

The communication system 100 of the vehicle consist 102 can at least partially concurrently communicate the movement control data signals via the first communication path 112 and the non-movement control data messages via the second communication path 114 (e.g., the communication of the movement control data messages and the communication of the non-movement control data messages occur concurrently, simultaneously, or at least partially overlap in time). For example, during a time period that communication units of the communication system 100 are transmitting and/or broadcasting the movement control data signals, the same or other communication units of the communication system 100 also can be transmitting and/or broadcasting the non-movement control data signals. This can permit for more information to be communicated by the communication system 100 when compared to some known wireless communication systems for vehicle consists, which may be limited to communicating both messages that remotely control movements and messages that report statuses of components of the vehicles in series due to limited bandwidth capabilities.

The communication system 100 can switch between which communication path 112, 114 is used to communicate the movement control data messages. For example, in the event of a failure or other event that prevents communication of movement control data signals along the first communication path 112, the communication system 100 may stop or suspend communication of non-movement control data messages via the second communication path 114. The communication system 100 may then communicate the movement control data signals via the second communication path 114 until the first communication path 112 is available.

Figure 2:
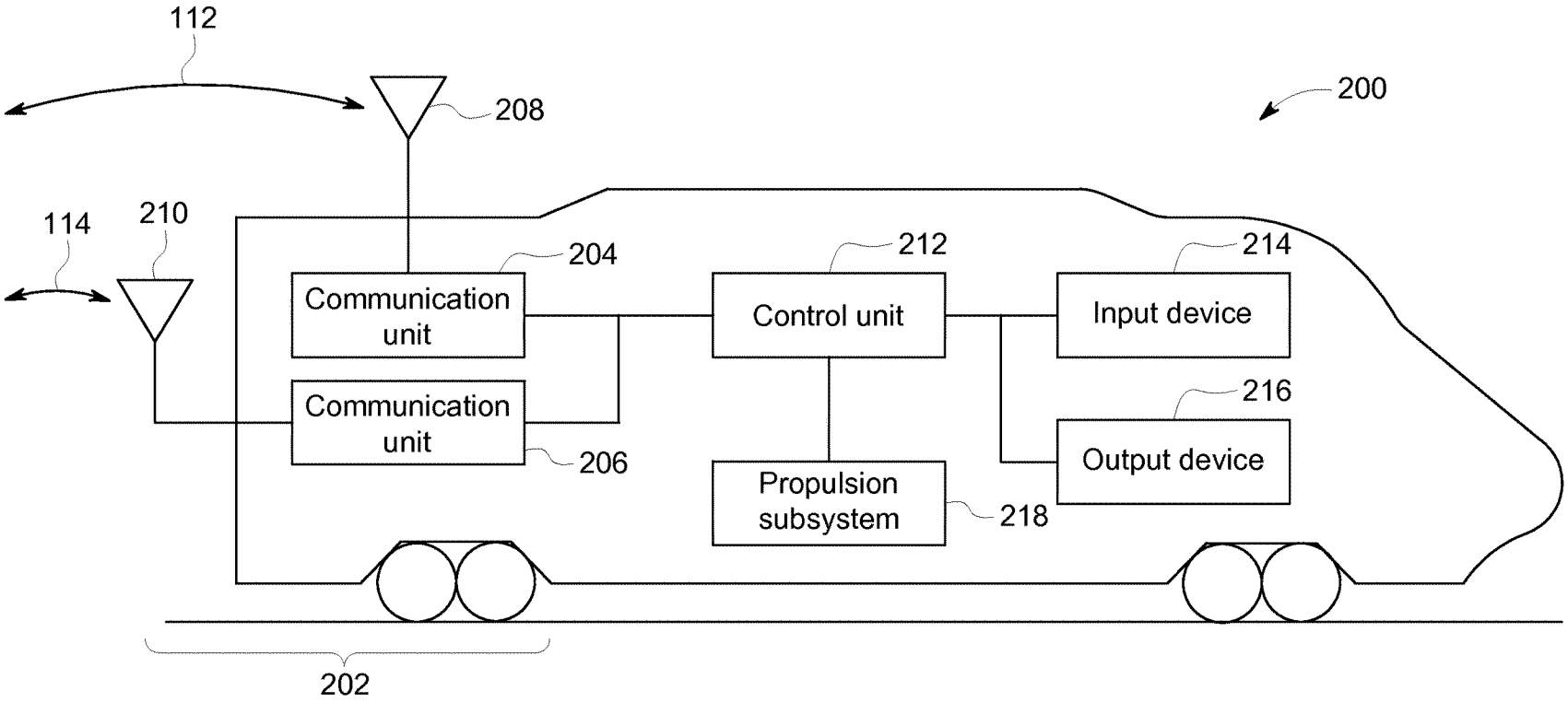
FIG. 2 is a schematic diagram of a propulsion-generating vehicle in accordance with one embodiment.

FIG. 2 is a schematic diagram of a propulsion-generating vehicle 200 in accordance with one embodiment. The vehicle 200 may represent one or more of the vehicles 104, 106 shown in FIG. 1. The vehicle 200 includes part of the communication system 100 shown in FIG. 1. For example, the communication system 100 may include two or more communication assemblies 202 disposed onboard two or more of the vehicles 104, 106. The communication system 100 can include a first communication assembly 202 disposed onboard the lead vehicle 104 and one or more second communication assemblies 202 disposed onboard one or more of the remote vehicles 106. The communication assembly 202 disposed onboard the lead vehicle 104 may be referred to as a lead communication assembly 202 while the communication assembly 202 disposed onboard a remote vehicle 106 can be referred to as a remote communication assembly 202.

In the illustrated embodiment, the communication assembly 202 includes communication units 204, 206 that separately communicate via the communication paths 112, 114. For example, the communication unit 204 may communicate movement control data messages with a similar or identical communication unit 204 onboard another vehicle 104, 106 via the first communication path 112 and the communication unit 206 may communicate non-movement control data messages with a similar or identical communication unit 206 onboard another vehicle 104, 106 via the second communication path 114.

The communication units 204, 206 include or represent hardware and/or software that is used to wirelessly communicate with other vehicles 104, 106 in the vehicle consist 102 using the different communication paths 112, 114. In one embodiment, at least one of the communication units 204, 206 can switch from using one communication path 112 or 114 to using the other communication path 114 or 112, as described above. The communication units 204, 206 can include transceivers, processors, and/or associated circuitry (represented as antennas 208, 210) for wirelessly communicating (e.g., communicating and/or receiving) the messages described herein. The communication units 204, 206 may differ from each other. For example, one communication unit 204 or 206 may be a radio communication unit (e.g., a radio) while the other communication unit 206 or 204 is not a radio communication unit (e.g., a cellular device). Alternatively, the communication units 204, 206 may be the same type of devices.

The vehicle 200 also includes a control unit 212 that controls operations of the vehicle 200. The control unit 212 can include or represent one or more hardware circuits or circuitry that include, are connected with, or that both include and are connected with one or more processors, controllers, or other hardware logic-based devices. The control unit 212 is connected with an input device 214 and an output device 216. The control unit 212 can receive manual input from an operator of the propulsion-generating vehicle 200 through the input device 214, such as a touchscreen, keyboard, electronic mouse, microphone, or the like. For example, the control unit 200 can receive manually input changes to the tractive effort, braking effort, speed, power output, and the like, from the input device 214. The control unit 212 can present information to the operator using the output device 216, which can represent a display screen (e.g., touchscreen or other screen), speakers, printer, or the like. This information can include information communicated from a remote vehicle 106 to the lead vehicle 104 or another remote vehicle 106 in one or more non-movement control data messages.

The control unit 212 can be used by an operator to input information into the vehicle 200, such as movement control data that is communicated by the communication assembly 202 to another vehicle 106 as a movement control data message to remotely control operations of the other vehicle 106 and/or non-movement control data that is communicated by the communication assembly 202 to another vehicle 104, 106 as a non-movement control data message to report on a status of one or more components of the vehicle 200, such as one or more components shown or represented in FIG. 2.

The control unit 212 is connected with a propulsion subsystem 218 of the vehicle 200. The propulsion subsystem 218 provides tractive effort and/or braking effort of the vehicle 200. The propulsion subsystem 218 may include or represent one or more engines, motors, alternators, generators, brakes, batteries, turbines, and the like, that operate to propel the vehicle 200 under the manual or autonomous control that is implemented by the control unit 212.

Figure 3:
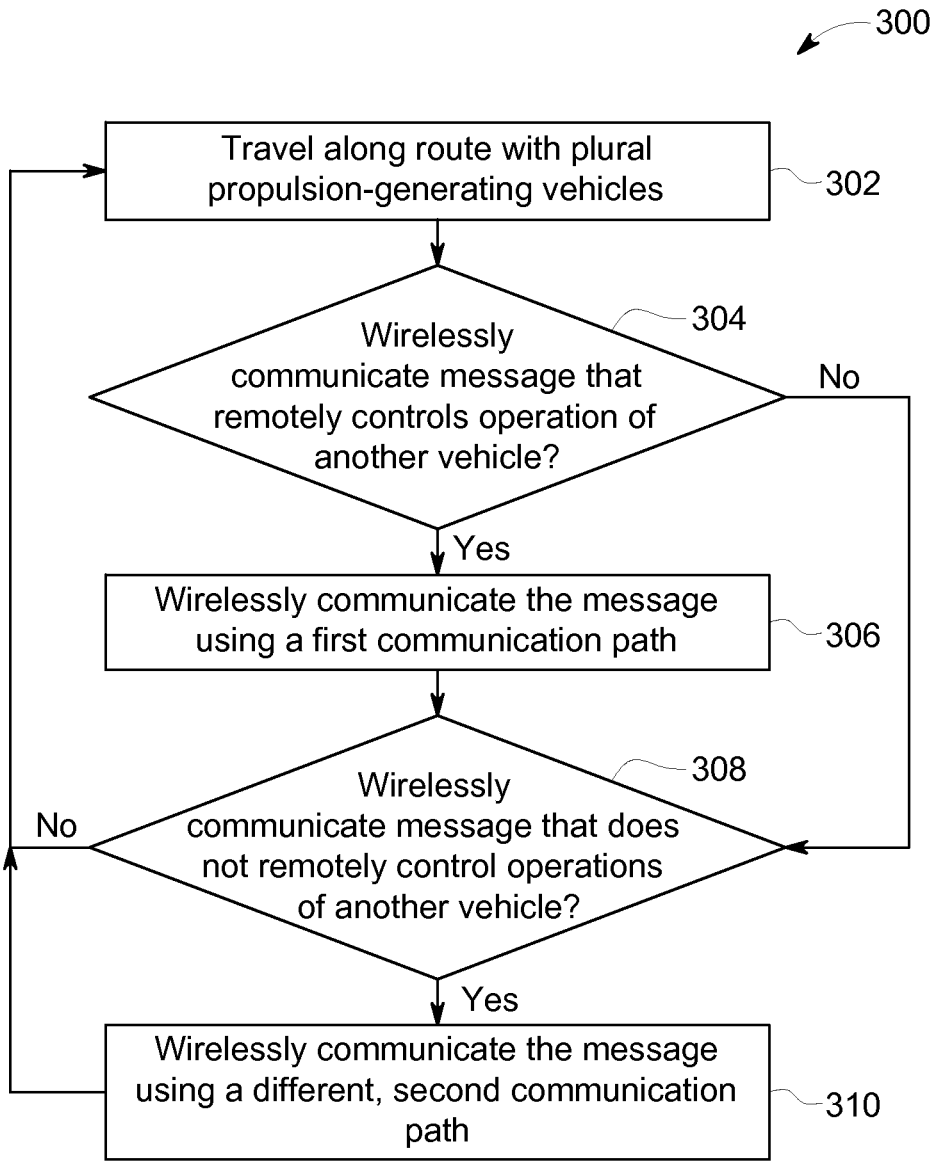
FIG. 3 is a flowchart of a method for wirelessly communicating messages in a vehicle consist according to one embodiment.

FIG. 3 is a flowchart of a method 300 for wirelessly communicating messages in a vehicle consist according to one embodiment. The method 300 may be performed by one or more embodiments of the communication system 100 shown in FIG. 1. For example, the method 300 may be performed by communication assemblies 202 (shown in FIG. 2) disposed onboard two or more vehicles 104, 106 (shown in FIG. 1) in the vehicle consist 100.

At 302, the vehicle consist 100 travels along the route 110 with two or more propulsion-generating vehicles 104, 106. The vehicles 104, 106 include a lead vehicle 104 and one or more remote vehicles 106, with the lead vehicle 104 remotely controlling operations of the remote vehicles 106 by wirelessly communicating movement control data messages to the remote vehicles 106. The remote vehicles 106 can report on faults or other problems of components onboard the remote vehicles 106 (or other components) by wirelessly communicating non-movement control data messages to the lead vehicle 104 and/or to each other.

At 304, a determination is made as to whether a movement control data message is to be communicated to another vehicle 106 to remotely control operation of the other vehicle 106. For example, the control unit 212 (shown in FIG. 2) disposed onboard the lead vehicle 104 may determine if the throttle setting, brake setting, speed, or the like, of a remote vehicle 106 needs to change to be coordinated with (e.g., synched in time with) a change in the operation of the lead vehicle 104 and/or another remote vehicle 106. Changes in the operations of the vehicles 104, 106 may need to be coordinated to prevent the vehicles 104, 106 from speeding up or slowing down at different times to compress and/or pull apart the vehicle consist 100.

If a movement control data message is to be communicated, then flow of the method 300 can proceed to 306. On the other hand, if no movement control data message is to be communicated (e.g., the lead vehicle 104 does not need to change operation of another vehicle 106), then flow of the method 300 can proceed to 308.

At 306, the movement control data message is wirelessly communicated using the first communication path 112 (shown in FIG. 1). As described above, the movement control data message is not communicated using the second communication path 114 (shown in FIG. 1), as the second communication path 114 may be too congested or otherwise unable to communicate the movement control data message within a sufficiently short time period to ensure that the change in operations of the vehicles 104, 106 are coordinated with each other.

At 308, a determination is made as to whether a non-movement control data message is to be communicated to another vehicle 104, 106 to communicate information that is not used to remotely control operation of the other vehicle 104, 106. For example, the control unit 212 disposed onboard a vehicle 106 may determine that a component (e.g., a traction motor, generator, brake, or the like) of the vehicle 106 is experiencing a fault or other problem. The control unit 212 may determine that information about this fault or other problem is to be communicated to the lead vehicle 104 so that an operator onboard the lead vehicle 104 can be informed of the potential fault or other problem. If a non-movement control data message is to be communicated, then flow of the method 300 can proceed to 310. On the other hand, if a non-movement control data message is not to be communicated, then flow of the method 300 can return to 302 so that the vehicle consist 102 can continue to travel along the route 110. Alternatively, if a trip of the vehicle consist 102 is complete and no further communications between the vehicles 104, 106 are to occur, then the method 300 can terminate.

At 310, the non-movement control data message is wirelessly communicated using the second communication path 114. In one embodiment, the non-movement control data message is not communicated using the first communication path 112, as the first communication path 112 may be dedicated to communicating movement control data messages, and not any non-movement control data messages. Flow of the method 300 can return to 302 so that the vehicle consist 102 can continue to travel along the route 110. Alternatively, if a trip of the vehicle consist 102 is complete and no further communications between the vehicles 104, 106 are to occur, then the method 300 can terminate.

In one embodiment, communication of one or more movement control data messages and one or more non-movement control data messages can occur concurrently or simultaneously. For example, due to the separate communication paths 112, 114 being used to separately communicate the movement control data messages and the non-movement control data messages, both types of messages may be communicated at the same time in one embodiment.

In one embodiment, a method (e.g., for communicating in a vehicle consist) includes wirelessly communicating (using communication assemblies disposed onboard a vehicle consist) a movement control data message via a first wireless communication path between a lead vehicle and a remote vehicle of the vehicle consist. The vehicle consist includes the lead vehicle and the remote vehicle operably coupled with each other to travel along a route. The method also includes wirelessly communicating a non-movement control data message via a different, second wireless communication path between the lead vehicle and the remote vehicle. The movement control data message is communicated to remotely control operation of the remote vehicle from the lead vehicle. The non-movement control data message is communicated to remotely report a status of a component onboard the remote vehicle.

In one aspect, the status that is reported by the non-movement control data message does not include the status of the remote vehicle or a status of implementing a directive or instruction received from the lead vehicle.

In one aspect, the first wireless communication path is a radio communication pathway and the second wireless communication path is a non-radio communication pathway.

In one aspect, the second wireless communication path is a cellular communication pathway and the first wireless communication path is a non-cellular communication pathway.

In one aspect, the second wireless communication path is a larger bandwidth communication pathway than the first wireless communication path.

In one aspect, wirelessly communicating the movement control data message is time dependent such that the movement control data message is communicated within a designated time limit so that the operation of the remote vehicle that is remotely controlled is changed in time-based coordination with a change in operation of the lead vehicle.

In one aspect, wirelessly communicating the non-movement control data message is not time dependent.

In one aspect, the method also includes presenting the non-movement control data message to an operator onboard the lead vehicle via an output device.

In one aspect, wirelessly communicating the non-movement control data message includes communicating at least the non-movement control data message in one or more data bursts that are separated in time by one or more time delays.

In one aspect, wirelessly communicating the movement control data message and wirelessly communicating the non-movement control data message occur at least partially concurrently. For example, the time period over which the movement control data message and the time period over which the non-movement control data message are communicated may begin and end at the same time (e.g., simultaneous communication), or these time periods may at least partially but not entirely overlap (e.g., concurrent communication).

In one aspect, the method also can include, responsive to a communication fault of the first wireless communication path that prevents communication of one or more additional movement control data messages over the first wireless communication path, stopping communication of one or more additional non-movement control data messages over the second wireless communication path, and communicating the one or more additional movement control data messages over the second wireless communication path.

In another embodiment, a system (e.g., a communication system of a vehicle consist) includes a remote communication assembly configured to be disposed onboard a remote vehicle of a vehicle consist that also includes a lead vehicle operably coupled with the remote vehicle to travel with each other along a route. The remote communication assembly is configured to wirelessly receive a movement control data message via a first wireless communication path between the lead vehicle and the remote vehicle of the vehicle consist. The remote communication assembly also can be configured to wirelessly communicate a non-movement control data message with the lead vehicle via a different, second wireless communication path between the lead vehicle and the remote vehicle. The remote communication assembly can be configured to receive the movement control data message to remotely control operation of the remote vehicle from the lead vehicle. The remote communication assembly can be configured to communicate the non-movement control data message to remotely report a status of a component onboard the remote vehicle.

In one aspect, the first wireless communication path is a radio communication pathway and the second wireless communication path is a non-radio communication pathway.

In one aspect, the second wireless communication path is a cellular communication pathway and the first wireless communication path is a non-cellular communication pathway.

In one aspect, the second wireless communication path is a larger bandwidth communication pathway than the first wireless communication path.

In one aspect, the remote communication assembly is configured to wirelessly communicate the movement control data message in a time dependent manner such that the movement control data message is communicated within a designated time limit so that the operation of the remote vehicle that is remotely controlled is changed in time-based coordination with a change in operation of the lead vehicle.

In one aspect, the remote communication assembly is configured to wirelessly communicate the non-movement control data message in a non-time dependent manner.

In one aspect, the remote communication assembly is configured to wirelessly communicate at least the non-movement control data message in one or more data bursts that are separated in time by one or more time delays.

In one aspect, the remote communication assembly includes a first communication unit configured to wirelessly communicate the movement control data message and a second communication unit configured to at least partially concurrently communicate the non-movement control data message. For example, the time period over which the movement control data message and the time period over which the non-movement control data message are communicated may begin and end at the same time (e.g., simultaneous communication), or these time periods may at least partially but not entirely overlap (e.g., concurrent communication).

In one aspect, the remote communication assembly can be configured to, responsive to a communication fault of the first wireless communication path that prevents communication of one or more additional movement control data messages over the first wireless communication path, stop communication of one or more additional non-movement control data messages over the second wireless communication path, and communicate the one or more additional movement control data messages over the second wireless communication path.

In another embodiment, another system (e.g., another communication system of a vehicle consist) includes a radio communication unit configured to be disposed onboard a remote vehicle of a vehicle consist that also includes a lead vehicle. The radio communication unit is configured to wirelessly receive a radio control message configured to remotely control movement of the remote vehicle from the lead vehicle. The system also includes a non-radio communication unit configured to be disposed onboard the remote vehicle and to wirelessly communicate a status message to the lead vehicle. The status message is representative of a status of one or more components of the remote vehicle. The radio communication unit is configured to wirelessly receive the radio control message within a designated time limit such that the radio control message temporally coordinates a change in the movement of the remote vehicle with a change in movement of the lead vehicle. The non-radio communication unit is configured to wirelessly communicate the status message without temporally coordinating the status message with the change in movement of the remote vehicle or the change in movement of the lead vehicle.

In one aspect, the non-radio communication unit is a cellular communication device.

In one aspect, the non-radio communication unit is configured to communicate the status message in one or more data bursts that are separated by one or more non-communication time delays.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose message processor, microcontroller, random access memory, hard disk, and the like). Similarly, the programs may be standalone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

The invention claimed is:

1. A method comprising:

wirelessly communicating, using communication assemblies disposed onboard a group of vehicles, a movement control data message via a first wireless communication path between a lead vehicle and a remote vehicle of the group of vehicles, the group of vehicles including the lead vehicle and the remote vehicle operably coupled with each other to travel along a route;

wirelessly communicating a non-movement control data message via a different, second wireless communication path between the lead vehicle and the remote vehicle, wherein the movement control data message is communicated to remotely control operation of the remote vehicle from the lead vehicle, wherein wirelessly communicating the movement control data message is time dependent such that the movement control data message is communicated within a designated time period so that the operation of the remote vehicle that is remotely controlled is changed in time-based coordination with a change in operation of the lead vehicle, wherein the non-movement control data message is communicated to remotely report a status of a component onboard the remote vehicle, wherein wirelessly communicating the non-movement control data message is not time dependent such that the non-movement control data message is not required to be communicated within the designated time period, wherein the movement control data message is communicated from the lead vehicle to the remote vehicle at the same time that the non-movement control data message is communicated from the remote vehicle to the lead vehicle, wherein a bandwidth of the first wireless communication path used to communicate the movement control data message is smaller than a bandwidth of the second wireless communication path used to communicate the non-movement control data message;

responsive to a communication fault of the first wireless communication path that prevents communication of one or more additional movement control data messages over the first wireless communication path, stopping communication of one or more additional non-movement control data messages over the second wireless communication path; and communicating the one or more additional movement control data messages over the second wireless communication path.

2. The method of claim 1, wherein the first wireless communication path is a radio communication pathway and the second wireless communication path is a non-radio communication pathway.

3. The method of claim 1, wherein the second wireless communication path is a cellular communication pathway and the first wireless communication path is a non-cellular communication pathway.

4. The method of claim 1, further comprising presenting the non-movement control data message to an operator onboard the lead vehicle via an output device.

5. The method of claim 1, wherein wirelessly communicating the non-movement control data message includes communicating at least the non-movement control data message in one or more data bursts that are separated in time by one or more time delays and preventing communication of the non-movement control data message during the one or more time delays.

6. The method of claim 1, wherein the movement control data message is formed from less data than the non-movement control data message.

7. A system comprising:

a remote communication assembly configured to be disposed onboard a remote vehicle of a group of vehicles that also includes a lead vehicle operably coupled with the remote vehicle to travel with each other along a route, the remote communication assembly configured to wirelessly receive a movement control data message that remotely controls operation of the remote vehicle via a first wireless communication path between the lead vehicle and the remote vehicle of the group of vehicles, the movement control data message communicated in a time dependent manner such that the movement control data message is received within a designated time period so that the operation of the remote vehicle that is remotely controlled is changed in time-based coordination with a change in operation of the lead vehicle, wherein the remote communication assembly also is configured to wirelessly communicate a non-movement control data message with the lead vehicle to report a status of the remote vehicle via a different, second wireless communication path between the lead vehicle and the remote vehicle, the non-movement control data message not being time dependent in that the non-movement control data message is not required to be communicated within the designated time period, wherein the movement control data message is communicated from the lead vehicle to the remote vehicle at the same time that the non-movement control data message is communicated from the remote vehicle to the lead vehicle, wherein a bandwidth of the first wireless communication path used to communicate the movement control data message is smaller than a bandwidth of the second wireless communication path used to communicate the non-movement control data message, and wherein, responsive to a communication fault of the first wireless communication path that prevents receipt of one or more additional movement control data messages over the first wireless communication path, the remote communication assembly stops communication of additional non-movement control data messages over the second wireless communication path and receives one or more additional movement control data messages over the second wireless communication path.

8. The system of claim 7, wherein the first wireless communication path is a radio communication pathway and the second wireless communication path is a non-radio communication pathway.

9. The system of claim 7, wherein the second wireless communication path is a cellular communication pathway and the first wireless communication path is a non-cellular communication pathway.

10. The system of claim 7, wherein the remote communication assembly is configured to wirelessly communicate at least the non-movement control data message in one or more data bursts that are separated in time by one or more time delays, and the remote communication assembly also is configured to prevent communication of the non-movement control data message during the one or more time delays.

11. The system of claim 7, wherein the movement control data message is formed from less data than the non-movement control data message.

12. A system comprising:

a radio communication unit configured to be disposed onboard a remote vehicle of a group of vehicles that also includes a lead vehicle mechanically separate from the remote vehicle, the radio communication unit configured to wirelessly receive a radio control message configured to remotely control movement of the remote vehicle from the lead vehicle; and a non-radio communication unit configured to be disposed onboard the remote vehicle and to wirelessly communicate a status message to the lead vehicle, the status message representative of a status of one or more components of the remote vehicle, wherein the radio communication unit is configured to wirelessly receive the radio control message within a designated time period such that the radio control message temporally coordinates a change in the movement of the remote vehicle with a change in movement of the lead vehicle, while the non-radio communication unit is configured to wirelessly communicate the status message without temporally coordinating the status message with the change in movement of the remote vehicle or the change in movement of the lead vehicle, wherein the radio communication unit is configured to receive the radio control message at the same time that the non-radio communication unit receives the status message, and wherein, responsive to a communication fault of the radio communication unit prevents receipt of the radio control message, the non-radio communication unit prevents receipt of the status message and switches to receiving one or more additional control messages that change the movement of the remote vehicle.

13. The system of claim 12, wherein the non-radio communication unit is a cellular communication device.

14. The system of claim 12, wherein the non-radio communication unit is configured to communicate the status message in one or more data bursts that are separated by one or more non-communication time delays.

* * * * *